United States Patent [19]

Blauhut et al.

[11] Patent Number: 4,706,531

[45] Date of Patent: Nov. 17, 1987

[54] DEVICE FOR CUTTING BAND-SHAPED OR STRAND-SHAPED MATERIAL

[75] Inventors: Wilfried Blauhut; Günter Hoschek; Robert Malojer, all of Linz, Austria

[73] Assignee: Chemie Linz Aktiengesellschaft, Linz, Austria

[21] Appl. No.: 828,114

[22] Filed: Feb. 10, 1986

[30] Foreign Application Priority Data

Feb. 22, 1985 [DE] Fed. Rep. of Germany ..... 3506282

[51] Int. Cl.[4] ..... D01G 1/04

[52] U.S. Cl. ..... 83/346; 83/663; 83/699; 83/913

[58] Field of Search ..... 83/346, 347, 348, 663, 83/698, 699, 913

[56] References Cited

U.S. PATENT DOCUMENTS

| | | | |
|---|---|---|---|
| 2,846,004 | 8/1958 | Fotland | 164/61 |
| 3,342,093 | 9/1967 | Billingsley | 83/402 |
| 3,503,100 | 3/1970 | Glynn et al. | 19/32 |
| 3,768,355 | 10/1973 | Farmer et al. | 83/403 |
| 4,445,408 | 5/1984 | Keith | 83/37 |
| 4,528,050 | 7/1985 | Arther et al. | 83/913 |
| 4,528,877 | 7/1985 | Fleissner | 83/37 |
| 4,538,490 | 9/1985 | Becker | 83/346 |
| 4,548,106 | 10/1985 | Fleissner | 83/913 |
| 4,576,621 | 3/1986 | Chappelear et al. | 83/913 |

FOREIGN PATENT DOCUMENTS 2609386 9/1977 Fed. Rep. of Germany .

*Primary Examiner*—Paul A. Bell
*Assistant Examiner*—Hien H. Phan
*Attorney, Agent, or Firm*—Mark Dryer

[57] ABSTRACT

Device for cutting band-shaped or strand-shaped material, having a cutting device in the form of a cutter roller, in which outwardly-pointing cutting edges which are arranged at a uniform distance from one another connect two circular disc-shaped or annular bodies to one another, which bodies hold the cutting edges, and the material to be cut via these cutting edges forms a lap superimposed in several coil layers, the radial innermost position of which lap is cut by the pressure which acts in intensified manner as a result of a loading body. The cutter blades, the cutting edges of which cut the material, are arranged for reducing the bending stress in such a way that they are at a setting angle alpha of 5° to 25° to the radial direction of the device, with the cutting edges pointing in the direction of movement of the cutter roller.

2 Claims, 4 Drawing Figures

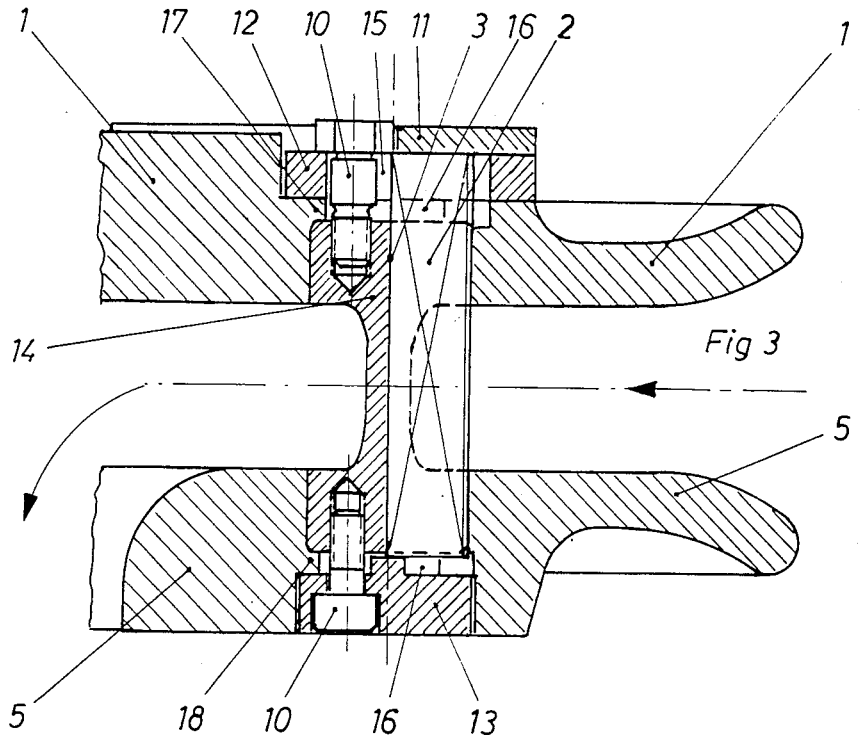
Fig 3
Fig 4
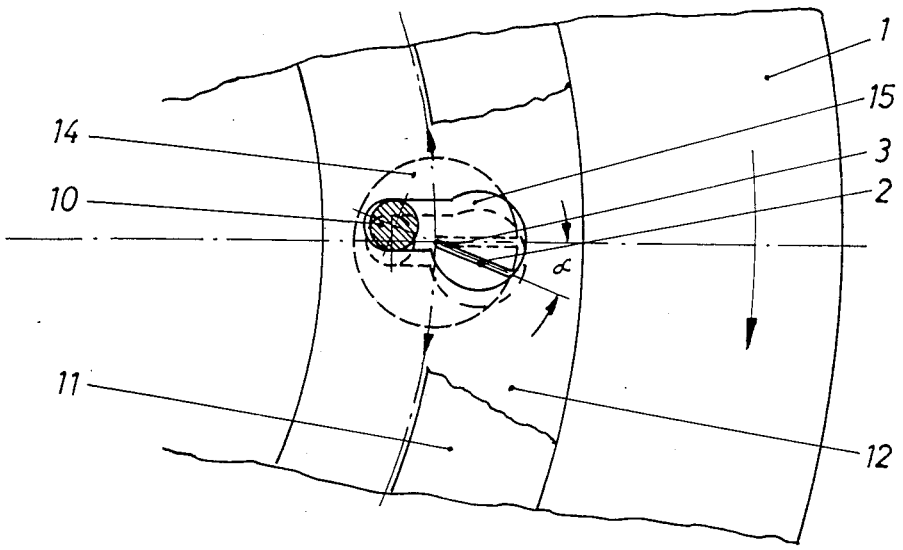

DEVICE FOR CUTTING BAND-SHAPED OR STRAND-SHAPED MATERIAL

BACKGROUND OF THE INVENTION

The present invention relates to a device for cutting band-shaped or cord-shaped material, in particular for manufacturing staple fibers, having a cutting device in the form of a cutter roller, with the cutter blades, which point outward with their cutting edges, representing a winding body which carries the material to be cut in radially superimposed coil layers, and the coil layer located radially innermost in each case is pressed against the cutting edges by an externally acting pressure and cut.

Such a device is known from U.S. Pat. No. 3,503,100. It consists of two circular disc-shaped cutter holders, of which the upper one is made as a disc and the lower one is made as a ring and which are held at a distance by radially outward-pointing cutter blades which are arranged at regular spacings over the entire periphery. These cutter holders, together with the cutter blades, form the winding body, onto which the material to be cut is firmly wound, with the layer which is located innermost in each case being cut into portions, the length of which is determined by the distance of the cutter blades from one another. If necessary, the pressure on the coil layers is intensified by an externally acting pressure device.

The cut fibers are pressed through the intermediate spaces between the cutter blades into the inside of the cutting device, from where they fall outward by the force of gravity or possibly even by suction action through that opening which is enclosed by the lower, annular cutter holder.

In this known device, the cutters provided as cutting edges can represent the only connection between the two cutter holders. For stability reasons, however, it is preferred that the two cutter holders are connected to one another by a plurality of U-shaped connecting pieces which extend parallel to one another at a distance and are connected to the two cutter holders by brazing or a similar method of fastening. These U-shaped bodies have a narrow slot which is continued in the upper cutter holder and which serves to accommodate the cutter blades.

This known device has the disadvantage that bending stress of the cutter blades occurs in operation, which bending stress leads to deformation and frequently to fractures of the cutter blades. Such fractures must be rectified immediately, because the cutting device is incapable of operating in the event of such a single fracture.

The consequence of this is that usually only relatively thick cutter blades can be used in such devices, which in turn means that the staple length of the fibers has a lower limit, and in fact to 4 to 8 times the blade thickness.

Attempts have therefore already been made repeatedly to counteract the frequent cutter fractures in another way. Thus it has been proposed according to the DE No. 2,609,386 to combine at least two of such winding body-like cutting devices with one another coaxially, with it being possible for the cutter spacings of the combined units to be equal inter alia. The strand to be cut can therefore be distributed over both cutter rollers and thus the pressure on the cutter blades can be reduced.

However, considerably more complicated and expensive apparatus has to be accepted for this increase in production reliability, because layers for two, superimposed rows of cutter blades have to be provided in the central, annular cutter holder. Moreover, this design leads to a reduction in the height of the openings between the cutter blades, which height, if a fiber blockage is to be avoided, places limits on the cutting speed.

According to U.S. Pat. No. 4,528,877 a simpler solution to the problem with respect to the apparatus is proposed inasmuch as only three regularly spaced cutter mountings are provided which carry only one set of cutter blades; that is, the central cutter holder is penetrated by the cutter blades and is only used to reduce the bending stress of the cutter blades. Here, too, compared with cutter rollers without this center strengthening, a considerable reduction in the inside diameter of the openings through which the staple fibers are to be pushed has to be accepted. In the two known solutions, moreover, the division of the original strand is difficult, because the threads do not lie exactly parallel and cling to the tow-separating members.

SUMMARY OF THE INVENTION

The object of the present invention is to create a cutting device in which the problem of a lack of durability of the cutters is neutralized in a simple manner without a greater expenditure on apparatus and practically without loss in the inside diameter of the openings between the cutter blades. It has been possible to achieve this object by creating a cutting device of the above-described type, in which the cutter blades, in contrast to the prior art, are not directed radially outward but are at an acute angle of a certain size to the radial direction, with the cutting edges pointing in the direction of movement of the cutter roller.

DETAILED DESCRIPTION

The subject matter of the present invention is accordingly a device for cutting band-shaped or strand-shaped material, in particular for manufacturing staple fibers, having a cutting device in the form of a cutter roller, in which several cutter blades which are arranged at a uniform distance from one another and have outwardly-pointing cutting edges on the periphery of the cutter roller are arranged between circular disc-shaped bodies holding these cutting edges, with the lower of these bodies being made as a ring and the cutter blades being made as a winding body which supports the material by means of at least one part of the cutting edges of the cutter blades in radially superimposed coil layers and holds the coil layer located radially innermost in each case, and also having a loading device which presses the material against the cutting edges, the cutter blades being held in the circular disc-shaped or annular-shaped bodies in such a way that they deviate from the radial direction by a setting angle alpha of 5° to 25°, with the cutting edges pointing in the direction of movement of the cutter roller.

It has in fact been discovered that the fracture of the cutter blades can be attributed to bending stress which acts in the peripheral direction on the cutter roller. These forces can be attributed on the one hand to the tow tension which is absolutely necessary for constructing a lap and on the other hand to the resistance to flexing of the fiber lap under the pressure roller. Both forces act against the rotary movement of the cutter roller. This bending stress thus caused transversely to the cutter plane can be eliminated by the inventive arrangement of the cutters about an angle alpha to the radial direction and in fact in the direction of movement, so that, despite a third cutter holder being dispensed with, fractures no longer occur through bending stress.

But in addition, the wear of the cutting edges is surprisingly reduced to a very considerable extent, so that the cutter life is increased quite considerably, namely twice as much and more.

The exact selection of the setting angle alpha within the area according to the invention depends of course on the condition and thread titer of the material to be cut, on the cutting wheel diameter and the pressure roller diameter, and also on the cutting length. It can be set to an optimum value for every material by preliminary tests. In this connection, setting angles of 10° to 20° are particularly preferred.

The cutter blades in the circular disc-shaped bodies which act as cutter holders can be fixed by any of the hitherto usual methods. Thus it is possible, for example, to recess slots into the circular disc-shaped bodies at a fixed angle alpha, which slots serve to mount the cutter blades.

However, the device according to the invention is expediently embodied in such a way that the mountings for the cutter blades are not simply recessed into the circular disc-shaped or annular cutter holders, but rather that the slots for accommodating the cutter blades, assembled individually or in groups, are made in separate parts which are detachably fixed to the circular disc-shaped or annular base bodies, for example screwed. This has the advantage that the production risk which is always present when milling a large number of slots is reduced.

Finally, in a particularly preferred embodiment of the present invention, when each individual cutter blade is fixed in a separate cutter holder, the latter can be rotatably mounted, so that the setting angle alpha is adjustable. This is therefore particularly advantageous, because the cutting device can then be adapted without great difficulty to the material to be cut and that position of the cutters can be selected in which the bending stress of the cutter blades is optimally removed by the setting angle.

Examples of such advantageous embodiments of the device according to the invention are shwon in FIGS. 1 to 4.

BRIEF DESCRIPTION OF THE DRAWINGS

FIGS. 3 and 4 illustrate a preferred embodiment of the device according to the invention.

DESCRIPTION OF THE PREFERRED EMBODIMENTS

Figure 2:
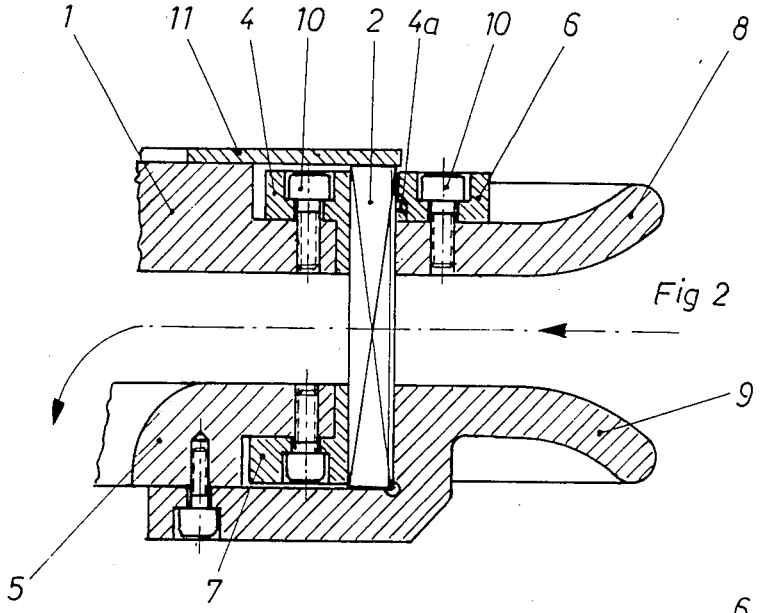
FIG. 2 illustrates a longitudinal section through the entire device, which section is designated as II—II in FIG. 1
Figure 1:
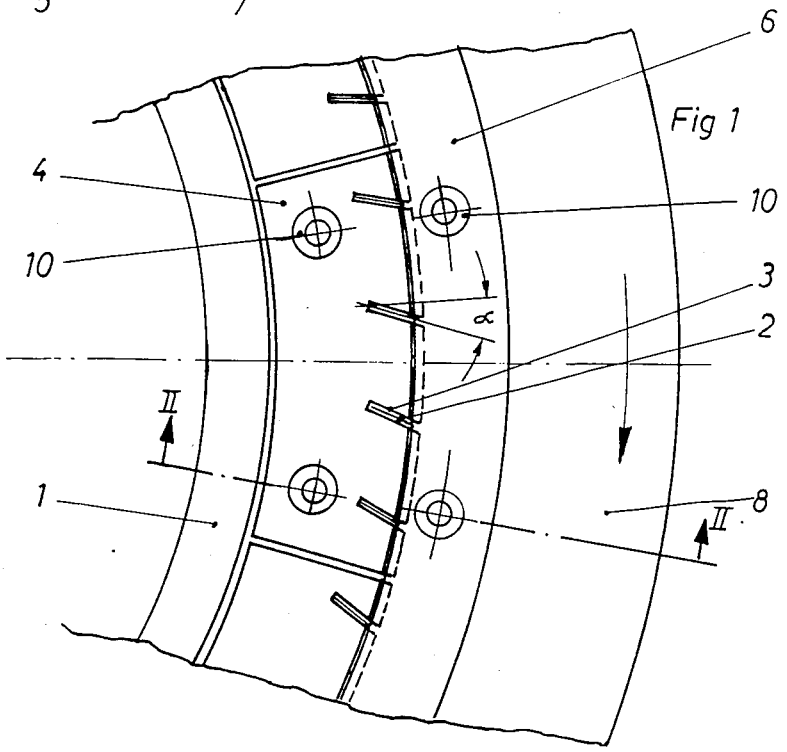
FIG. 1 illustrates a plan view of the circular disc-shaped body

FIGS. 1 and 2 here represent an embodiment of the device according to the invention in which, although the setting angle alpha is specified as fixed, the slots which hold the blades are made in groups, and in fact in the example shown have 4 slots in each group, in separate blade holders which have the form of a circular arc sector and are screwed to the circular disc-shaped or annular base bodies which represent the upper and lower limiting part of the winding body. In these figures, the upper circular disc-shaped base body is designated as 1, the cutter blades which are at an angle alpha to the radius of the circular cross-section of the device are designated as 2, the slots which accomodate the cutter blades are designated as 3, and the upper and lower cutter holders which have the shape of a circular arc sector and are connected to the base bodies 1 and 5 via screws 10 are designated as 4 and 7 respectively.

FIG. 1 represents a plan view of the circular disc-shaped body 1 and FIG. 2 represents a longitudinal section through the entire device, which section is designated as II—II in FIG. 1. The slots 3 recessed into the cutter holders 4 and 7 are open at the periphery. At the same time, the slots 3 in the upper cutter holder 4 are defined outward by the likewise screwed cover ring 6 in such a way that the slots 3 have exactly the same size at the top as the cutter blades 2. This becomes particularly clear from FIG. 1. The cutter blades 2 fitting into the slots 3 sit at the bottom on a shaped part 9 which covers downward both the cutter holder 7 and the screw 10 fixing the latter and is also screwed to the lower base body 5. The shaped part 9 extends further outward beyond the cutting edge of the cutter blades 2 and is curved downward at the outermost end. Thus it forms, together with a shaped part 8 which is curved symmetrically upward and is directly connected to the upper base body 1, a funnel-shaped widening which facilitates the construction of the yarn package. Since the slot 3 is open at the side of the cutting edge, the shaped part 9 represents the outward limit for the lower part of the cutter blades. The cover ring 6, together with the shaped part 8 with which it is screwed, assumes this function in the upper part of the winding body. The cutter holder 4 is equipped with a projection 4*a* which extends beyond the cutter blade 2 and into a recess in the cover ring 6 below the latter and is clamped between the cover ring 6 and the shaped part 8 via the screw connection, by means of which a connection is made via the cutter holder 4 between the base body 1 and the shaped part 8 located outside the cutter blades. To prevent the cutter blades from rising perpendicularly upward as a result of the flexing work, they are covered by cover plates 11. These cover plates 11 are subdivided several times over the entire periphery, preferably at the same point as the cutter holders 4. This has the advantage that only one such segment has to be removed if a cutter blade 2 is damaged, and then the damaged cutter blade can easily be exchanged for a new one. For reasons of clearer representation, these cover plates are not shown in FIG. 1.

A particularly preferred embodiment of the device according to the invention is shown in FIGS. 3 and 4, in which the setting angle alpha of the cutter blades is adjustable and therefore involves the advantage of adaption to the particular application. In this embodiment, each individual cutter blade 2 is held by slots 3 in a separate cutter holder which can be seen in longitudinal section from FIG. 3 and is designated there as 14. These cutter holders 14 consist of one upper and one lower cylinder-shaped head which are connected by an intermediate part of smaller cross-section which is made up of two frustum-shaped extensions and a cylindrical intermediate part. The cylinder-shaped heads of the cutter holders 14 are located in cylinder-shaped bores in the lower and upper circular disc-shaped bodies 5 and 1, in which they can rotate within a small angle about their rotationally symmetrical axes.

The slot 3 for accommodating the cutter blade 2 is recessed in this cutter holder 14 in the radial direction, which slot 3 extends approximately as far as the center point of the circular cross-section of the same, which at the same time is the center of rotation of the cutter holder 14, and is also open at the periphery in the area of the heads as well as at the upper and lower side, which involves advantages for production. In the direction of the imaginary continuation of the slot 3 inward, one threaded hole each which is only open upward or downward and is intended for accommodating the screws 10, by means of which the cutter holders 14 are firmly clamped nonrotationally in the base bodies 1 and 5, is located in both the upper and the lower head part of the cutter holder 14. Turning the screws 10 and the cutter blade 2 in the base bodies 1 and 5 about the rotationally symmetrical axis of the cutter holder 14 is made possible by corresponding recesses 16 in the base bodies 1 and 5. The cutter holders 14 are connected at the top via screws 10 with a common adjusting ring 12 and at the bottom each cutter holder 14 is connected via screw 10 with its own clamping disc 13 Edge parts 17 and 18 of the base bodies 1 and 5 are clamped in between and therefore produce a firm connection between the cutter holders 14, the base bodies 1 and 5 and the adjusting ring 12 and the clamping discs 13. As in the embodiment according to FIGS. 1 and 2, the cutter blades 2 are also prevented from shifting upward in the device shown in FIGS. 3 and 4 by a cover plate 11.

For reasons of clearer representation, the cover plate in FIG. 4 has been cut away in the area of the cutter holders 14 to reveal the view of the adjusting ring 12 located thereunder. The adjusting ring 12 is located above the upper circular disc-shaped body 1. To adjust the setting angle alpha, the screws 10 must be loosened and the adjusting ring 12 be appropriately turned relative to the circular disc-shaped body 1. As a result of this, since the adjusting ring 12 is connected to the cutter holders 14 via the screws 10, the cutter holders 14 turn uniformly through a certain angle about their rotationally symmetrical axis and thus change the angle between the radius of the device and slot 3. Since the screws 10 therefore move with the adjusting ring 12, only one recess 15 is necessary in the adjusting ring 12 for accommodating the relatively slight screw movement in the radial direction. This enables the heads of the screws 10, at the inner half of their periphery, to sit firmly on the adjusting ring and they are thus able to clamp the base body 1 between the cutter holder 14 and the adjusting ring 12. Since the cutter slots 3 are displaced in their position to the adjusting ring 12, the recess 15 here must be of such a size that it is possible to remove the cutter in each position. The recess 16 present in the base body 1 above the cutter holder 14 is likewise widened in the area of the cutter blade 2 to facilitate cutter removal even when the angle is changed. It is enclosed above the cutter holder 14 by edge parts 17 of the base body 1, which edge parts 17 overlap the recess 15 and serve to connect the base body 1 to the adjusting ring 12 and the cutter holders 14. Likewise, the lower base body 5 has edge parts 18 of this kind which are clamped between the clamping disc 13 and the cutter holder 14. In the area of the screws 10, the recess 16 must be of such a size that it is able to accommodate the screw movement. On the other hand, a recess for accommodating the screw movement is not necessary in the clamping disc 13, because each cutter holder 14 is equipped with a separate clamping disc 13.

Replacing a cutter blade 2 in the event of fracture is also possible without problem in this embodiment of the device according to the invention, because only the cover plate 11 need be removed for this purpose.

However, other embodiments of the device according to the invention are of course possible, in particular that with individual rotatable cutter holders. Thus, for example, the heads of the cutter holders can also be made polygonal, the connecting pieces of the heads of the cutter holders can be made flattened at the side to increase the inside diameter of the opening between the latter, the position of the screws in the cutter holders can be selected differently, and of course embodiments are also possible in which the cutter slots extend beyond the center of rotation of the cutter holders or also deviate from the radial direction, with respect to the cutter holder. All of these embodiments are likewise subject matter of the invention.

What we claim is:

1. A device for cutting band-shaped or strand-shaped material comprising a movable cutter roller defined by a circular periphery and containing a plurality of cutter blades at a uniform distance from one another, wherein said cutter blades have outwardly-facing cutting edges located around the periphery of said cutter roller and between a lower and an upper circular disc-shaped body, said lower disc-shaped body being in the form of a ring and said cutter blades being arranged as a winding body which supports said material by means of at least one part of the cutting edges of said cutting blades in radially superimposed coil layers and holds the innermost of said coil layers in each case, and a loading device which presses said material against the cutting edges, wherein each of the cutter blades is held by slots in separate individual cutter holders which are rotatably mounted in bores in the lower and upper circular disc-shaped bodies and which are attached by means of screws to an adjusting ring located above the upper base body, so that by turning said adjusting ring relative to the upper base body, the cutter holders turn simultaneously about their axes, whereby a setting angle alpha to the radius of the circular cross-section of the device of 5° to 25° for the cutter blades with the cutting edges facing in the direction of movement of the cutter roller is adjusted uniformly at all cutter holders by turning said adjusting ring.

2. A device as claimed in claim 1, wherein the setting angle alpha is 10° to 20°.

* * * * *